United States Patent [19]

Dunn

[11] 4,203,521

[45] May 20, 1980

[54] PACKET FOR PROVIDING THERMAL PROTECTION FOR DOCUMENTS

[75] Inventor: Stanley A. Dunn, Madison, Wis.

[73] Assignee: J. E. Enterprises, Inc., Madison, Wis.

[21] Appl. No.: 932,192

[22] Filed: Aug. 9, 1978

[51] Int. Cl.[2] ..... B65D 65/40; B65D 85/00

[52] U.S. Cl. ..... 206/525; 150/52 R; 229/3.5 MF; 229/87 R; 220/418; 220/450

[58] Field of Search ..... 206/525, 454, 5; 229/55, 87 R, 3.5 MF; 220/450, 418; 150/52 R

[56] References Cited

U.S. PATENT DOCUMENTS

| | | | |
|---|---|---|---|
| 1,715,533 | 6/1929 | Bowersock | 206/454 |
| 2,322,345 | 6/1943 | Cage | 220/450 |
| 2,929,425 | 3/1960 | Slaughter | 206/5 |
| 3,066,847 | 12/1962 | Fortune | 229/55 |

*Primary Examiner*—William T. Dixson, Jr.
*Attorney, Agent, or Firm*—Michael, Best & Friedrich

[57] ABSTRACT

A packet for containing documents and for providing thermal protection of those documents, the packet including a sacrificial ablating layer surrounding the documents, and a metal foil covering for shielding the ablating layer from contact with surrounding air. The sacrificial ablating layer of the packet may be comprised of a plurality of layers of paper forming an envelope for receiving the documents therein. In one embodiment, the envelope is formed by a plurality of stacked layers of paper, the stacked layers having a cruciform configuration having a central rectangular portion and a top flap extending from one of the edges of the rectangular portion, a bottom flap extending from an opposed edge and a pair of side flaps, the flaps being folded over the central rectangular portion to form an envelope for containing the documents to be protected. In an alternative embodiment the packet is comprised of a cylindrical configuration formed from a plurality of sheets of paper assembled in stacked relation, the cylindricl body being formed by stacking a layer of metal foil, a plurality of sheets of paper and the document and then rolling the foil, paper and document to form a cylindrical body having an outer surface covered by the metal foil.

9 Claims, 7 Drawing Figures

PACKET FOR PROVIDING THERMAL PROTECTION FOR DOCUMENTS

BACKGROUND OF THE INVENTION

The invention relates to packages and envelopes for protecting documents or other valuable papers from destruction by exposure to excessive temperatures. More particularly, the invention relates to such packages having a sacrificial ablative material surrounding the documents to be protected. The ablative material functions to absorb heat by an ablative or endothermic chemical reaction, thereby preventing that heat from destroying the documents contained therein.

An example of a prior art fire resistant envelope is illustrated in U.S. Pat. No. 3,066,847 issued Dec. 4, 1962. An object contained in the envelope shown therein is surrounded by relatively thick layers of hydrated material containing water in molecular form and intended to release water vapor into the area around the object protected by the envelope to thereby protect the object from heat.

Another fire resistant receptacle is shown in U.S. Pat. No. 2,492,422 issued Dec. 27, 1949. That patent shows a file cabinet or safe having walls including relatively thick layers of hydrated material such as gypsum. If the file cabinet is subjected to heat, the hydrated material functions to emit water vapor into the receptacle of the file cabinet to protect documents contained therein.

Attention is also directed to U.S. Pat. No. 2,214,172, issued Sept. 10, 1940 and showing a metal foil pouch providing a recloseable hermetically sealed closure and comprised of thin walls consisting of metal foil and fibrous material, the pouch being intented to contain tobacco and the like and to prevent loss of moisture.

SUMMARY OF THE INVENTION

The invention provides a convenient and inexpensive packet for containing documents and for providing thermal protection for those documents, and a method for making the packet, the packet including a sacrificial ablating layer surrounding the documents, and means for covering the sacrificial ablating layer for shielding the sacrificial ablating layer from surrounding air.

In one embodiment of the invention the sacrificial ablating layer is comprised of a cellulose material, the cellulose material being formed from a plurality of layers of paper.

In one embodiment of the invention the means for shielding the sacrificial ablating layer from surrounding air includes metal foil surrounding the sacrificial ablating layer and including at least one opening therein providing for egress of ablative gases from the sacrificial ablating layer.

In one embodiment of the invention, the sacrificial ablating layer may comprise a plurality of stacked layers of paper having a cruciform configuration covered by metal foil, and the cruciform configuration having a central rectangular portion having edges, a top flap extending from one of the edges, a bottom flap extending from another of the edges, and a pair of opposed side flaps extending from opposite edges, the flaps being foldable over the central rectangular portion to form an envelope for containing the documents.

In another embodiment of the invention, the packet may have a cylindrical configuration comprised of a plurality of sheets of paper in stacked relation and forming the ablative layer, and the covering means comprised of metallic foil, the plurality of sheets of paper and the documents being stacked and rolled to form a cylindrical body having a cylindrical surface covered by metallic foil. The cylindrical configuration is further provided with cylindrical metal caps, the cylindrical metal caps each including an open end and a closed end, the open end of the cylindrical metal caps housing one end of the cylindrical body.

Other features and advantages of the invention will become known by reference to the following description, to the appended claims, and to the drawings.

Figure 1:
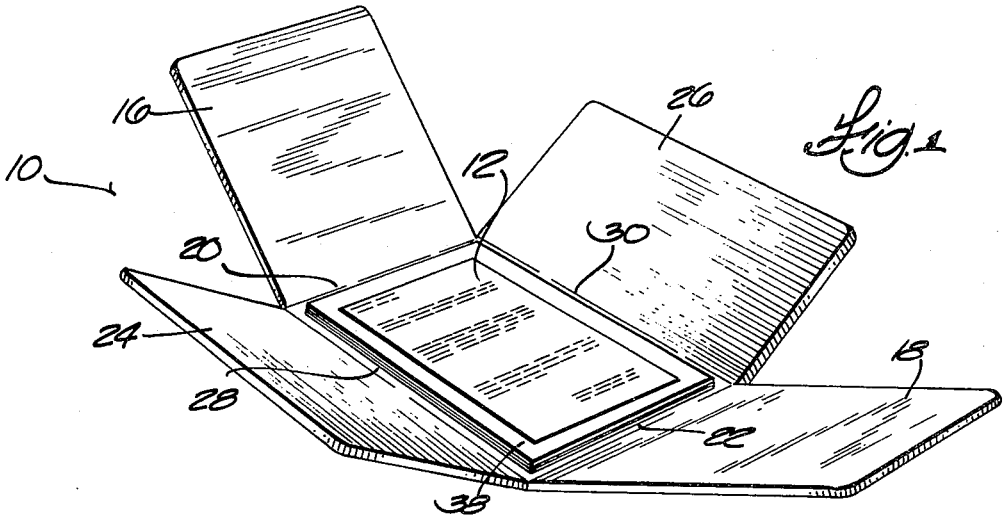
FIG. 1 is a perspective view of the ablative envelope of the invention in an open position and with a document positioned on a central portion thereof.

Before explaining at least one embodiment of the invention in detail it is to be understood that the invention is not limited in its application to the details of construction and the arrangement of the components set forth in the following description or illustrated in the drawings. The invention is capable of other embodiments and of being practiced and carried out in various ways. Also it is to be understood that the phraseology and terminology employed herein is for the purpose of description and should not be regarded as limiting.

DESCRIPTION OF THE PREFERRED EMBODIMENT

Figure 2:
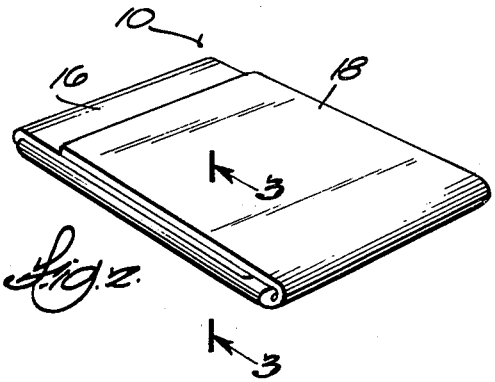
FIG. 2 is a perspective view of the ablative envelope shown in FIG. 1 and showing the side and end flaps of the cruciform envelope configuration folded over to form the ablative envelope.

Illustrated in FIGS. 1 and 2 is a package 10 for providing thermal protection for documents, such as a document 12. The package 10 is generally intended to provide an envelope for containing the document 12 and includes sacrificial material surrounding the document for absorbing heat energy through an ablative process to thereby prevent destruction of the document contained in the envelope. The package 10 generally comprises a layer of energy absorbing ablative material surrounding the document, and the ablative material being covered by a material which is capable of withstanding elevated temperatures and which will preclude exposure of the energy absorbing or ablative material to oxygen in the surrounding air.

The material used to form the sacrificial ablative layer for surrounding the document can be any material which will absorb heat through ablation in the absence of oxygen. For cost effectiveness and weight effectiveness, a number of cellulose products are particularly effective sacrificial materials. Such products may include paper products or wood pulp. Since newspaper is particularly inexpensive, it has been found to be an especially well suited alternative. Furthermore, paper products such as newspaper have a plurality of other advantages. For example, paper has a high cellulose content and has a low thermal conductivity, thereby providing good thermal insulation of the protected document. Newspaper also retains its physical structure during pyrolysis, such that it remains porous and facilitates the escape of gases generated during its ablation. Additionally, the gaseous ablation products, including carbon monoxide, water vapor and hydrogen, are not unusually dangerous or toxic.

If the sacrificial paper forming the ablative layer is surrounded by a material which precludes contact of the paper with the oxygen in the ambient air when the envelope is placed in a heated environment, the paper will serve to absorb substantial heat energy because the heat surrounding the envelope will cause an endothermic pyrolysis of the paper wherein the paper is caused to yield water vapor, hydrogen, carbon monoxide and other gases. By surrounding the protected document with the sacrificial ablative paper layer, the heat energy or elevated temperature surrounding the envelope or package will not reach the protected document until all of the sacrificial paper has been consumed in this fashion. It is necessary, however, that the paper surrounding the document be shielded from the surrounding air, since contact of the paper at high temperatures with oxygen will result in combustion of the paper; i.e., result in an exothermic chemical reaction and the document contained therein will be quickly destroyed.

While other materials may be used as an outer covering to shield the ablative material from the air, aluminum foil provides a particularly desirable material. The outer covering layer, though intended to prevent access of oxygen to the sacrificial material, must not be hermetic or the gases formed during pyrolysis of the sacrificial material will burst the outer covering. By using aluminum foil to form the outer envelope or covering and by folding over the edges of the aluminum foil to join those edges and to form the required seams in the envelope, labyrinthine channels are formed by folds in the foil thereby facilitating escape of ablative gases. Oxygen or air is prevented from entering through these labyrinthine channels by egress of the ablative gases.

Figure 3:
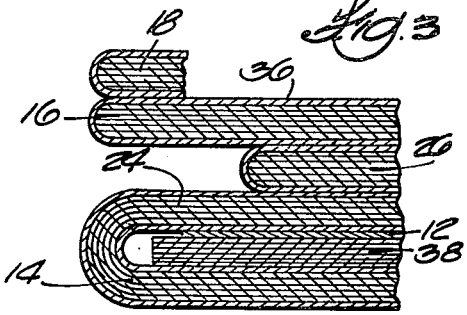
FIG. 3 is a cross-section view taken along lines 3—3 in FIG. 2.

In one embodiment of the invention shown in FIGS. 1–3, the ablative envelope 10 is formed by a plurality of stacked layers of paper, the stacked layers of paper being cut to form a cruciform configuration. The cruciform configuration includes a central rectangular portion 14 having a length and width greater than the respective length and width of the document 12 such that the edges of the central rectangular portion overlap the edges of the document 12. The cruciform configuration further includes a pair of end flaps 16 and 18 connected to the respective opposite ends 20 and 22 of the central rectangular portion 14. The end flaps 16 and 18 are rectangular and each have a width approximating that of the central rectangular portion 14. As shown in FIG. 2, the end flaps 16 and 18 are slightly shorter in length than the central rectangular portion 14. The cruciform configuration also includes a pair of side flaps 24 and 26, extending perpendicularly to the end flaps 16 and 18. The side flap 24 extends integrally from an edge 28 of the central rectangular portion 14 and side flap 26 similarly extends integrally from the edge 30 of the central rectangular portion 14. The side flaps 24 and 26 each have a length approximating the length of the side edges 28 and 30 and have a width slightly less than that of the central rectangular portion 14.

In the embodiment of the invention illustrated in FIGS. 1–3, the cruciform configuration of stacked paper is covered by a layer of material which is resistant to heat and which prohibits contact of the ambient air with the stacked paper. While various materials can be used, as previously stated metal foil such as aluminum foil 36 is conveniently employed and particularly well suited because it permits egress of gases generated during ablation of the sacrificial material. Though the edges of the metal foil can be joined by folding them, the edges of the aluminum foil can also be secured together in various other manners, provided escape of the ablative gases is permitted.

The envelope construction shown in FIG. 1 also includes a rectangular stack of paper 38 positioned on the central rectangular portion 14 and intended to support the document 12. A sheet of aluminum foil is laid over the upper surface of the stack of paper 38 for supporting the document 12. The rectangular stack of paper 38 is somewhat shorter in length and narrower in width than the central rectangular portion 14, but has dimensions greater than those of document 12. The rectangular stack of paper 38 is intended to provide an additional layer of ablative material between the document 12 and the surface of the envelope or package 10.

The ablative envelope 10 is formed by folding the side flaps 24 and 26 over the document 12 and by the folding the end flaps 16 and 18 over the side flaps 26. When the ablative envelope is formed in this manner, the document 12 is protected from heat by two layers 18 and 38 of ablative material below the document 12 and by layers 24, 26, 16 and 18 above the document.

Figure 5:
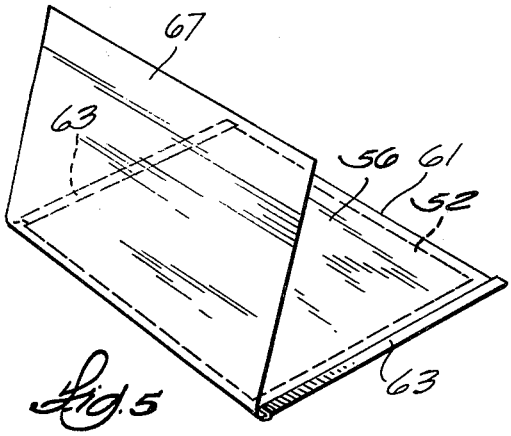
FIGS. 4 and 5 are perspective views of an alternative embodiment of the ablative envelope of the invention.
Figure 4:
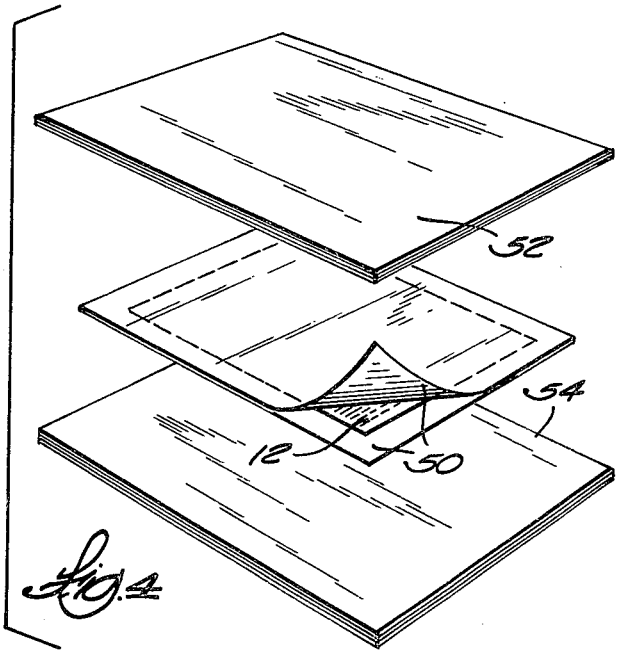

An alternative embodiment of the ablative envelope is illustrated in FIGS. 4 and 5. The document 12 contained therein is first placed between layers of aluminum foil 50. The aluminum foil-wrapped document is then placed between two rectangular stacks 52 and 54 of newspaper and the newspaper stacks and aluminum foil-wrapped document are then placed within an envelope 56 formed of aluminum foil. The aluminum foil envelope 56 is comprised of a single rectangular sheet of aluminum foil folded to form two layers of aluminum foil integrally joined along their lower edges 61. A flap 67 of aluminum foil extends integrally from one of the layers of aluminum foil and can be folded over the open edge of the envelope so formed to close the envelope. To join the sides 63, the edges of the aluminum foil are folded over twice. One skilled in the art will recognize that in an alternative embodiment, the aluminum foil envelope 56 may further include layers of ablative paper sandwiched between two rectangular layers of aluminum foil and in the manner shown in FIG. 5 to form the envelope 56.

As an example of the construction shown in FIGS. 4 and 5, a single sheet of typed paper, functioning as a surrogate document, was wrapped in aluminum foil having a thickness of 0.001 inches. This package was then placed between two stacks of newspaper as shown in FIG. 4, the newspaper stacks each having a thickness of approximately 0.225 inches. The newspaper stacks having the aluminum foil-wrapped document therebetween were then placed in an aluminum foil envelope as shown in FIG. 5. This envelope was then placed in an oven at approximately 1,000° F. for one-half hour. After being protected by the ablative envelope, the surrogate document was intact and only slightly charred. The print on the surrogate document was legible.

In a second example, a single sheet of surrogate document was enclosed within 0.001 inch thick aluminum foil to protect the document. The wrapped document was then placed on a stack of 75 sheets of newspaper, each sheet having a thickness of approximately 0.003 inches and the stack of newspaper having a cruciform configuration as shown in FIG. 1. The newspaper was folded over the document in the manner described in connection with FIGS. 1-3 and the wrapped document was then enclosed within an outer covering of aluminum foil having a thickness of 0.004 inches. The aluminum foil was folded in the manner shown in FIG. 5 to form an envelope for containing the wrapped document and including a large foldable flap, and with the edges of the aluminum foil at the sides of the envelope being folded over twice to prevent access of air into the envelope through the sides. The newspaper package was inserted into the aluminum foil envelope and the large flap folded over. This ablative package was placed in a 1,000° F. oven for one-half hour. The surrogate document survived with only minor browning at the edges. A similar ablative envelope was exposed to 1,000° F. for one hour. The surrogate document contained therein was embrittled, especially around the edges where type was only barely legible, but the central regions of the document were easily readable and lighter in color.

Figure 6:
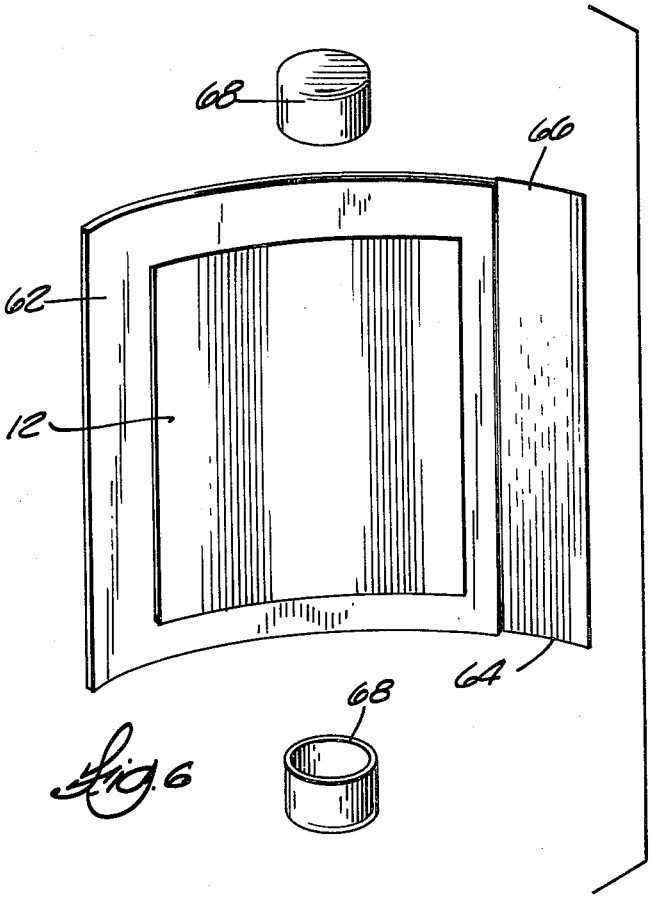
FIG. 6 is an exploded perspective view of another alternative embodiment of an ablative envelope in accordance with the present invention.
Figure 7:
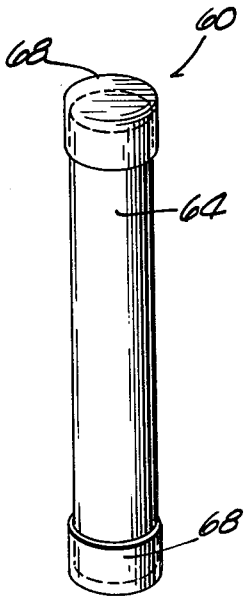
FIG. 7 is a perspective view showing the components of FIG. 6 in an assembled relation.

Another alternative embodiment of the invention is shown in FIGS. 6 and 7 wherein an ablative package 60 is shown as having a cylindrical construction. In the embodiment shown therein, a document 12 is positioned centrally on a stack of sheets of newspaper 62, the newspaper sheets being rectangular and larger than the document 12. The newspaper stack 62 is similarly placed on a sheet of aluminum foil 64, the sheet of aluminum foil having one end 66 extending beyond the edge of the stacked newspaper 62 in the manner shown in FIG. 6. The aluminum foil 64 and stack of newspaper 62 is then rolled up to form a cylindrical structure enveloping the document 12 as shown in FIG. 7. The opposite ends of the cylindrical structure are then covered by cylindrical end caps 68. The newspaper stack and aluminum foil are rolled up such that the aluminum foil 64 surrounds the resulting cylindrical structure and the end caps function to prevent access of ambient air to the ends of the cylinder. In the preferred form, the document 12 should be narrower than the newspaper stack 62 and the aluminum foil 64 such that the edges of the document 12 are spaced inwardly from the ends of the cylindrical structure when the materials are rolled up. Additionally, a sheet of aluminum foil could be placed between the document 12 and the stack of paper 62.

As an example of an ablative envelope 60 formed in the manner shown in FIGS. 6 and 7, a surrogate document 12 was placed on a stack of 68 sheets of newspaper. The newspaper stack was covered by a layer of aluminum foil and the covered newspaper stack was positioned on a sheet of thicker aluminum foil. The aluminum foil, newspaper and document were then rolled up to form a cylinder as shown in FIG. 7 and the opposite ends of the cylinder were capped by cylindrical metal caps. Heating of the resulting ablative package for one-half hour at 700°-800° F. left the surrogate document therein almost unchanged.

In the embodiments of the invention described above, aluminum foil was placed against the surfaces of the surrogate document. Though protection of the document by this layer of aluminum foil is not mandatory, the aluminum foil adjacent the document functions to keep ablation vapors away from the document to prevent deposit of ablation materials on the surface of the document during ablation of the newspaper layer and to thereby facilitate cleanliness of the document.

Various of the features of the invention are set forth in the following claims.

I claim:

1. A packet containing documents and providing thermal protection for those documents, said packets comprising:

a sacrificial ablative layer comprised of a plurality of layers of paper, and a metal foil layer enclosing said sacrificial ablative layer shielding the sacrificial ablative layer from surrounding air, said sacrificial ablative layer and said metal foil encasing the documents.

2. A packet as set forth in claim 1 wherein said metal foil layer includes at least one opening therein providing for egress of ablative gases from said sacrificial ablative layer.

3. A packet as set forth in claim 1 wherein said sacrificial ablative layer includes a plurality of stacked layers of paper having a cruciform configuration enclosed in said metal foil and said cruciform configuration having a central rectangular portion having edges, a top flap extending from one of said edges, a bottom flap extending from another of said edges, and a pair of opposed side flaps extending from opposite edges.

4. A packet as set forth in claim 1 wherein said sacrificial ablative layer includes a plurality of sheets of paper in stacked relation, and wherein said metal foil layer, said plurality of sheets of paper and said document are assembled in stacked relation and rolled to form a cylindrical body having a cylindrical surface covered by metallic foil, and wherein each portion of each document is positioned between two portions of said sacrificial ablative layer.

5. A packet as set forth in claim 4 wherein said cylindrical body has opposite ends and further including cylindrical metal caps capping said opposite ends, said cylindrical caps each including an open end and a closed end, said open ends housing one end of said cylindrical body.

6. A packet as set forth in claim 4 wherein the document is contained between helical portions of said sacrificial ablative layer.

7. A method for constructing a packet for containing documents and providing thermal protection for those documents, said method comprising, surrounding the document with a plurality of layers of paper to form a sacrificial ablating layer and enclosing said sacrificial ablating layer in a layer of metal foil shielding the sacrificial ablating layer from surrounding air.

8. The method set forth in claim 7 and including the steps of:

forming a stack of a plurality of layers of paper, said stack having cruciform configuration and including a central rectangular portion having edges, a top flap extending from one of said edges, a bottom flap extending from another of said edges, and a pair of opposite side flaps extending from opposite edges, enclosing said stack in metal foil, positioning the document on said central rectangular portion, and folding said flaps over the document.

9. The method as set forth in claim 7 and including the steps of forming a rectangular stack of a plurality of layers of paper, positioning said rectangular stack of paper on a layer of metal foil, positioning the document on said rectangular stack of paper, and rolling said layer of metal foil, rectangular stack of paper and said document to form a cylinder with said metal foil covering the outer surface of said cylinder.

* * * * *